US011013283B2

(12) United States Patent
Holterman

(10) Patent No.: US 11,013,283 B2
(45) Date of Patent: May 25, 2021

(54) HOVER COVER

(71) Applicant: The Hover Cover LLC, Chickasha, OK (US)

(72) Inventor: Mark James Holterman, Chickasha, OK (US)

(73) Assignee: The Hover Cover LLC, Chickasha, OK (US)

( * ) Notice: Subject to any disclaimer, the term of this patent is extended or adjusted under 35 U.S.C. 154(b) by 0 days.

(21) Appl. No.: 15/997,182

(22) Filed: Jun. 4, 2018

(65) Prior Publication Data

US 2018/0343951 A1 Dec. 6, 2018

Related U.S. Application Data

(60) Provisional application No. 62/514,361, filed on Jun. 2, 2017.

(51) Int. Cl.
*A42B 1/206* (2021.01)
*A42B 1/002* (2021.01)
(Continued)

(52) U.S. Cl.
CPC ..... *A42B 1/206* (2013.01); *A42B 1/002* (2013.01); *A42B 1/004* (2013.01); *A42B 1/205* (2013.01);
(Continued)

(58) Field of Classification Search
CPC ..... A42B 1/206; A42B 1/241; A42B 1/205; A42B 1/225; A42B 1/004; A42B 1/002;
(Continued)

(56) References Cited

U.S. PATENT DOCUMENTS 1,236,984 A * 8/1917 Reiss ..... A42B 1/002 2/175.4
1,303,796 A * 5/1919 Hinton ..... A42B 1/002 2/175.4
(Continued)

FOREIGN PATENT DOCUMENTS

CN 201906275 U * 7/2011
DE 10154164 A1 * 5/2003 ..... A42B 7/00
(Continued)

*Primary Examiner* — Khoa D Huynh
*Assistant Examiner* — Grace Huang
(74) *Attorney, Agent, or Firm* — Martin S. High, P.C.; Martin High

(57) ABSTRACT

Embodiments of The Hover Cover are comprised of one central rod, a left middle rod, a right middle rod, a left-side rod, a right-side rod, a left-side arm, a right-side arm, a central support, a crossbar, a brim-support, a brim, a hat cover, and a sizer. The central rod, the left middle rod, and the right middle rod span nearly the length of The Hover Cover and are connected on the back side of The Hover Cover to the back fitting and on the front side of The Hover Cover to the brim-support. The left-side rod and right-side rod extend from the back fitting to the brim-support on their respective sides of The Hover Cover. The crossbar transects The Hover Cover and is integrally formed with the brim-support. Connected to the crossbar is the central support. The brim extends forward from the brim-support.

7 Claims, 5 Drawing Sheets

(51) Int. Cl.

| | |
|---|---|
| ***A42B 1/205*** | (2021.01) |
| ***A42C 5/04*** | (2006.01) |
| ***A42B 1/004*** | (2021.01) |
| ***A42B 1/22*** | (2006.01) |
| ***A42B 1/241*** | (2021.01) |

(52) U.S. Cl.
CPC ..... *A42B 1/22* (2013.01); *A42B 1/225* (2013.01); *A42B 1/241* (2013.01); *A42C 5/04* (2013.01)

(58) Field of Classification Search
CPC .. A42B 1/22; A42B 1/20; A42B 1/201; A42B 3/04; A42C 5/04; Y10T 403/34; Y10T 403/341; Y10T 403/347; Y10T 24/344; Y10T 24/3444; A41G 3/0041
USPC ..... 2/173.5, 171.03, 171.1, 209.11, 209.12, 2/195.5, 175.4, 411; 132/53, 54
See application file for complete search history.

(56) References Cited

U.S. PATENT DOCUMENTS 1,656,073 A * 1/1928 Nixon ..... A42B 1/002 2/181
1,742,132 A * 12/1929 Chamberlin ..... G02C 3/02 2/10
2,490,508 A * 12/1949 Delgatto ..... A42B 1/002 223/23
2,659,481 A * 11/1953 Jones ..... A42B 1/18 206/8
2,713,444 A * 7/1955 Dombrowski ..... A42B 1/002 223/25
3,014,220 A * 12/1961 Weld ..... A42B 1/201 2/171
3,370,304 A * 2/1968 Pelletier ..... A42B 1/061 2/174
4,326,301 A * 4/1982 Brock ..... A45B 11/04 135/16
4,370,073 A * 1/1983 Ohme ..... E04B 1/19 403/172
4,637,805 A * 1/1987 Sweetin ..... A61C 15/02 403/172
4,765,495 A * 8/1988 Bisk ..... A47F 5/13 211/113
4,991,236 A * 2/1991 Pritchett ..... A42B 7/00 132/57.1
4,999,851 A * 3/1991 Hall ..... A42B 1/201 2/175.5
5,172,837 A * 12/1992 Finney, Jr. ..... A42B 1/002 2/209.5
5,406,971 A * 4/1995 Taylor ..... A41G 3/0041 132/201
5,987,640 A * 11/1999 Ryder ..... G02C 3/02 2/10
6,405,414 B1 * 6/2002 Byrnes ..... A61M 25/00 24/339
6,413,004 B1 * 7/2002 Lin ..... B25B 7/02 403/171
6,691,382 B1 * 2/2004 Su ..... B65D 7/20 24/335
6,892,503 B1 * 5/2005 Kang ..... E04H 15/34 403/170
7,146,995 B2 * 12/2006 Lapping ..... E04H 15/44 135/121
8,177,104 B2 * 5/2012 Bryant ..... D06F 59/02 223/12
8,733,293 B2 * 5/2014 Link ..... A01K 1/0017 119/474
9,702,137 B2 * 7/2017 Larsen ..... E04B 1/1903
10,786,025 B2 * 9/2020 Toba ..... A41G 3/0041
2007/0118977 A1 * 5/2007 Brier, Jr. ..... A41F 9/00 2/338
2010/0325842 A1 * 12/2010 Rivera ..... G09F 21/02 24/3.4
2014/0026920 A1 * 1/2014 Gelfand ..... A45D 8/36 132/273
2015/0327620 A1 * 11/2015 Tremoureux ..... A42B 7/00 2/338
2017/0000206 A1 * 1/2017 Chong ..... A42B 1/205

FOREIGN PATENT DOCUMENTS

FR 2591867 A1 * 6/1987 ..... A42B 1/201
GB 191027432 A * 8/1911 ..... A42B 1/22
GB 191125169 A * 11/1912 ..... A42B 1/201

* cited by examiner

HOVER COVER

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE EMBODIMENTS

Field of the Embodiments

The general field of the embodiments of The Hover Cover is hats, specifically frames that support hats over the head of wearers.

SUMMARY OF THE EMBODIMENTS

Embodiments of The Hover Cover are comprised of one central rod, a left middle rod, a right middle rod, a left-side rod, a right-side rod, a left-side arm, a right-side arm, a central support, a crossbar, a brim-support, and a brim, a hat cover, and a sizer. The central rod, the left middle rod, and the right middle rod span nearly the length of The Hover Cover and are connected on the back side of The Hover Cover to the back fitting and on the front side of The Hover Cover to the brim-support. The left-side rod and right-side rod extend from the back fitting to the brim-support on their respective sides of The Hover Cover. The crossbar transects The Hover Cover and is integrally formed with the brim-support. Connected to the crossbar is the central support. The brim extends forward from the brim-support.

There has thus been outlined, rather broadly, the more important features of the embodiments in order that the detailed description thereof that follows may be better understood, and in order that the present contribution to the art may be better appreciated. There are, of course, additional features of the embodiments that will be described hereinafter and which will form the subject matter of the claims appended hereto.

In this respect, before explaining at least one embodiment of the embodiments in detail, it is to be understood that the embodiment is not limited in this application to the details of construction and to the arrangements of the components set forth in the following description or illustrated in the drawings. The embodiment or embodiments are capable of other embodiments and of being practiced and carried out in various ways. Also, it is to be understood that the phraseology and terminology employed herein are for description and should not be regarded as limiting. As such, those skilled in the art will appreciate that the conception, upon which this disclosure is based, may readily be used as a basis for the designing of other structures, methods and systems for carrying out the several purposes of the embodiments. Additional benefits and advantages of the embodiments will become apparent in those skilled in the art to which the present embodiments relate from the subsequent description of the preferred embodiment and the appended claims, taken in conjunction with the accompanying drawings. It is important, therefore, that the claims be regarded as including such equivalent constructions insofar as they do not depart from the spirit and scope of the embodiments.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the embodiments of the application which is measured by the claims, nor is it intended to be limiting as to the scope of the embodiments in any way.

DETAILED DESCRIPTION OF THE PREFERRED EMBODIMENTS

Figure 1A:
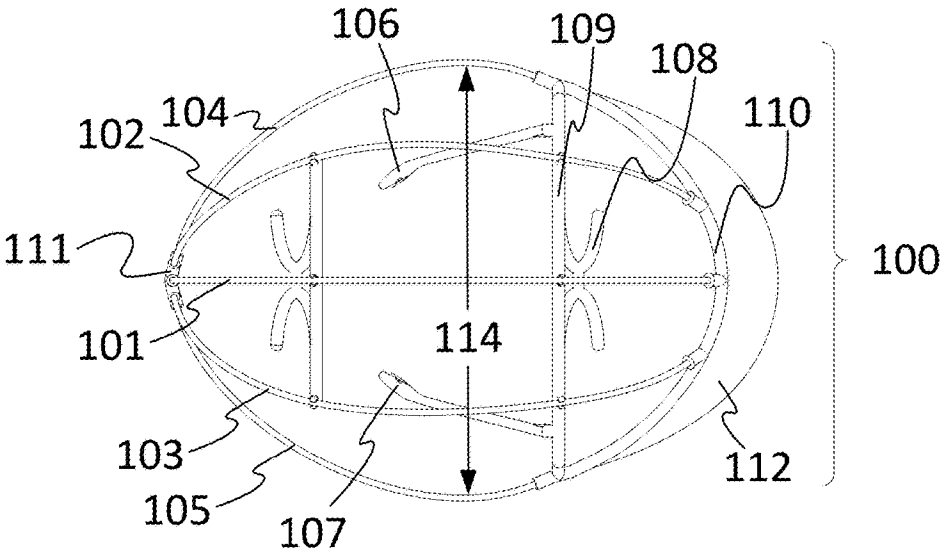
FIG. 1A is a top view of an embodiment of The Hover Cover.
Figure 1C:
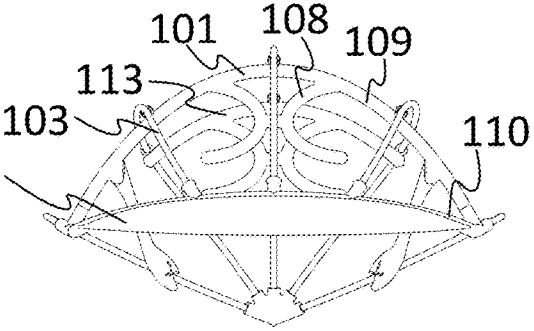
FIG. 1C is a front view of an embodiment of The Hover Cover.
Figure 1B:
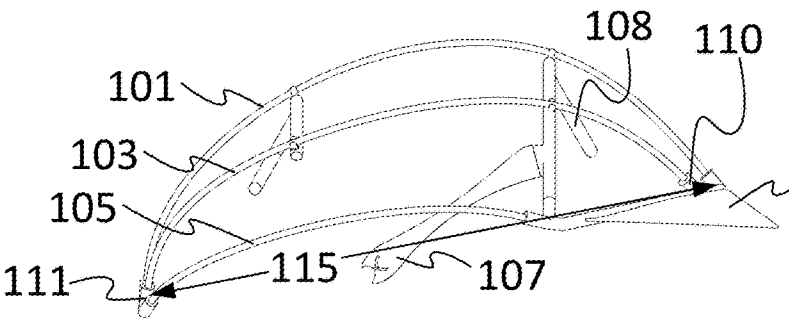
FIG. 1B is a right-side view of an embodiment of The Hover Cover.
Figure 2B:
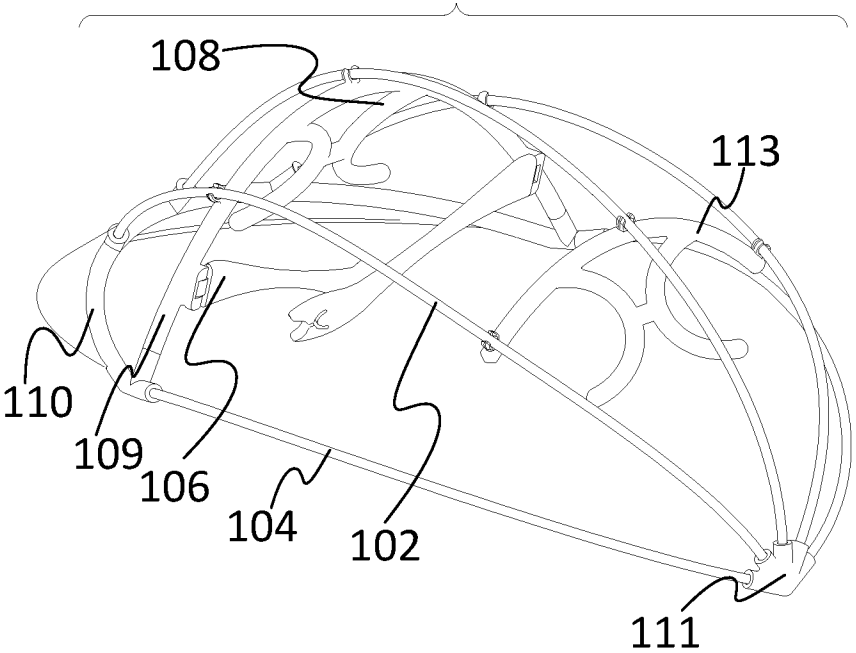
FIG. 2B is a perspective view of an embodiment of The Hover Cover.
Figure 2A:
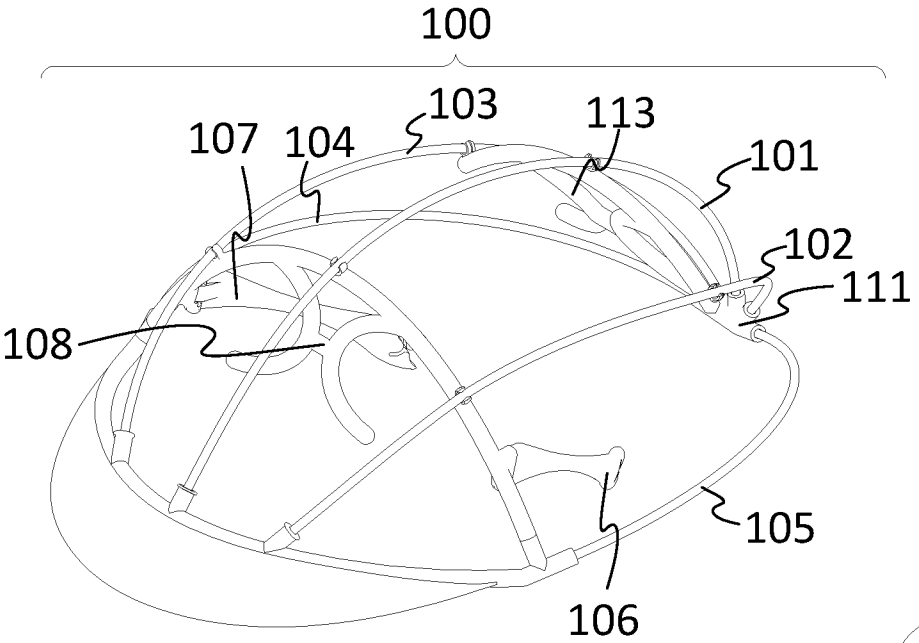
FIG. 2A is a perspective view of an embodiment of The Hover Cover.
Figure 3:
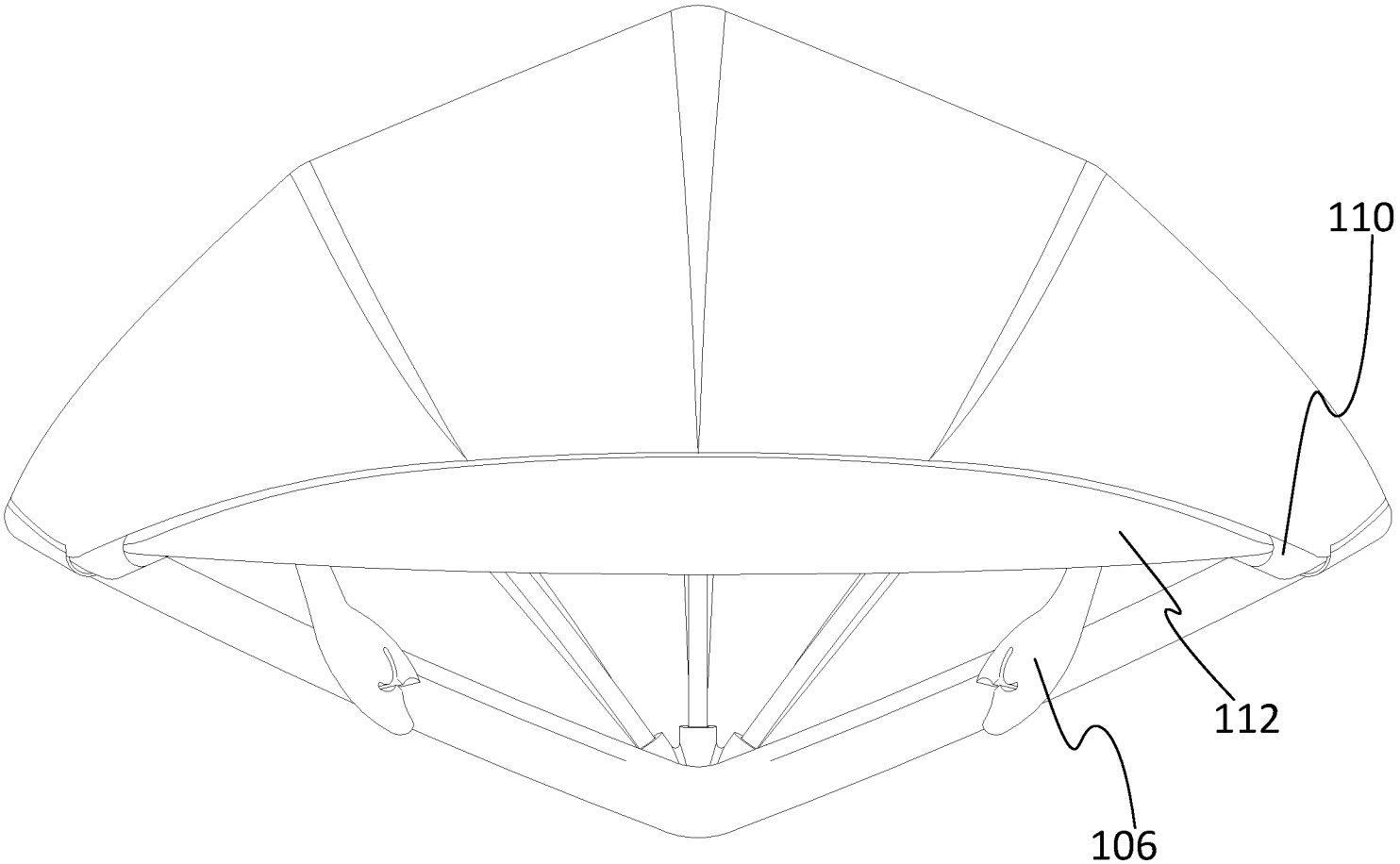
FIG. 3 is a front view of an embodiment of The Hover Cover with the hat cover attached.
Figure 4A:
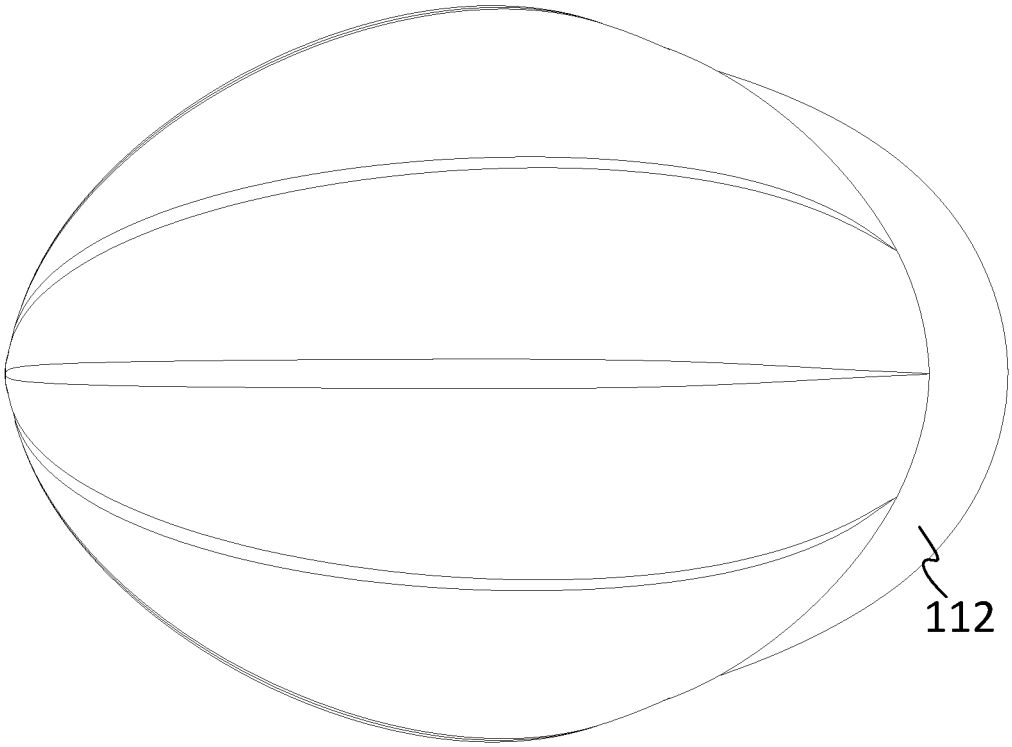
FIG. 4A is a top view of an embodiment of The Hover Cover with the hat cover attached.
Figure 4B:
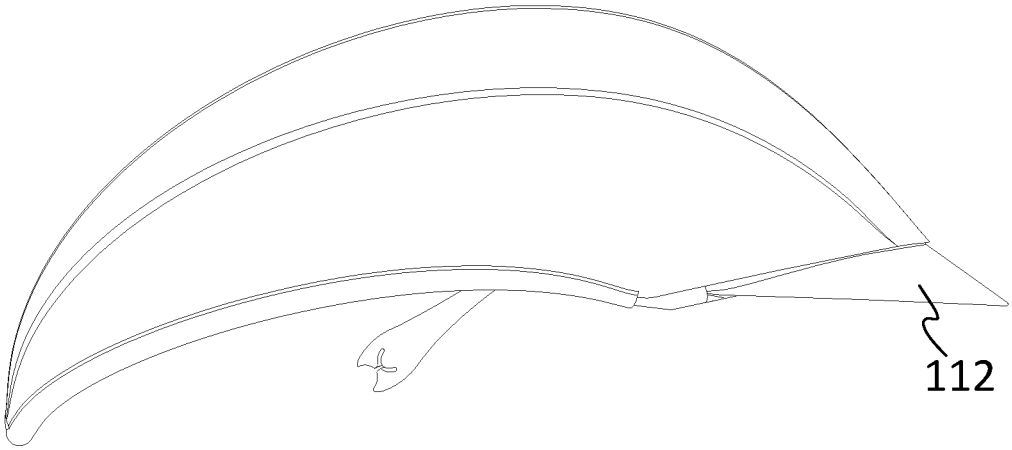
FIG. 4B is a side view of an embodiment of The Hover Cover with the hat cover attached.
Figure 5:
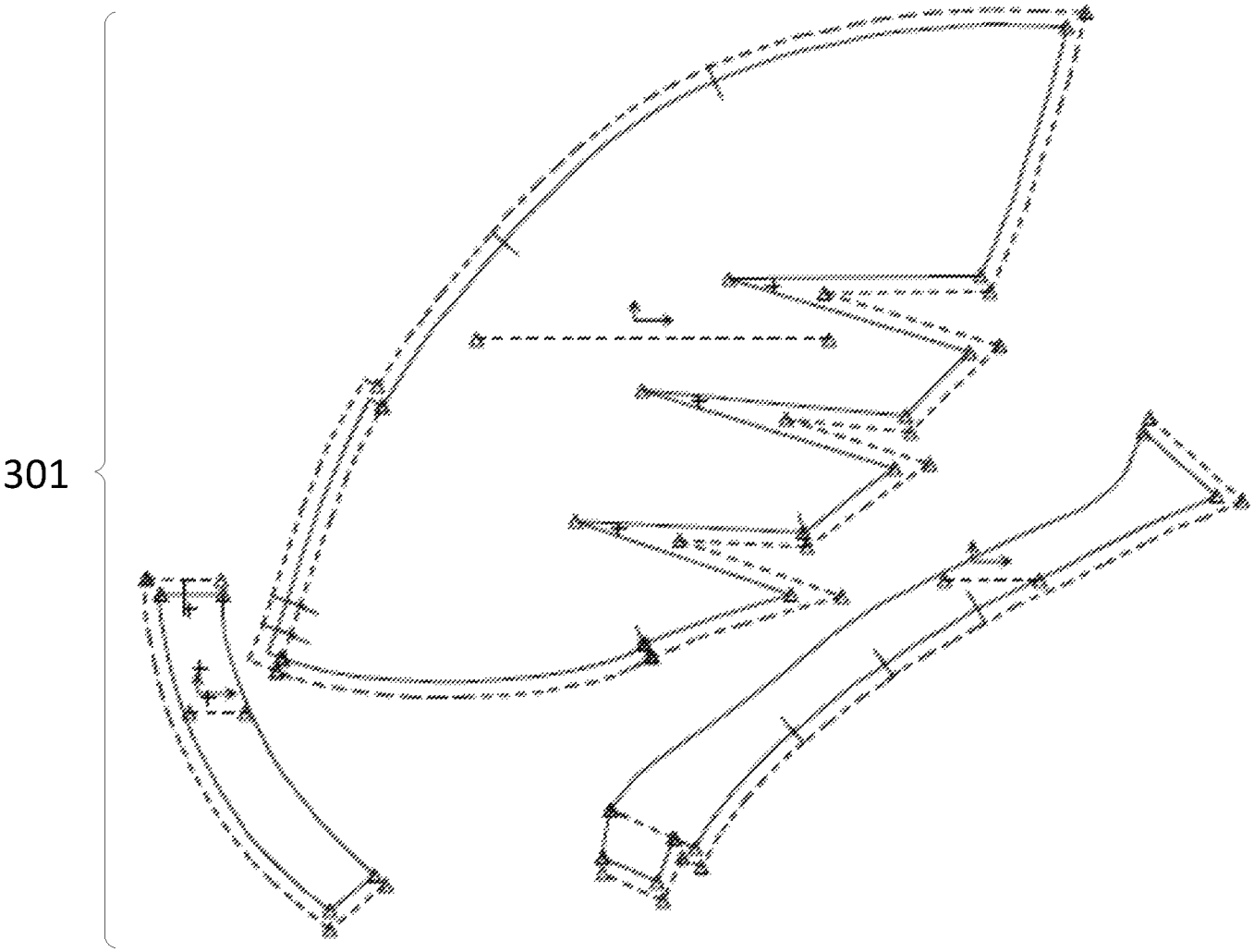
FIG. 5 is a cut-out view of an embodiment of The Hover Cover.

Embodiments of The Hover Cover 100 (a hat frame) are comprised of one central rod 101, a left middle rod 102, a right middle rod 103, a left-side rod 104, a right-side rod 105, a left-side arm 106, a right-side arm 107, a central support 108, a crossbar 109, a brim-support 110, a brim 112, a hat cover 301, and a sizer 113.

The central rod 101, the left middle rod 102, and the right middle rod 103 span nearly the length 115 and width 114 of The Hover Cover 100 and are connected on the back side of The Hover Cover 100 to the back fitting 111 and on the front side of The Hover Cover 100 to the brim-support 110. The back fitting 111 forms five receiving apertures where the central rod 101, left middle rod 102, right middle rod 103, left-side rod 104, and right-side rod 105, are connected via a resistance fit. The brim-support 110 also forms five apertures where the central rod 101, left middle rod 102, right middle rod 103, left-side rod 104, and right-side rod 105, are connected via a resistance fit.

The left-side rod 104 and right-side rod 105 extend from the back fitting 111 to the brim-support 110 on their respective sides of The Hover Cover 100. A brim 112 extends forward from the brim-support 110. The sizer 113 snaps into the central rod 101, the left middle rod 102, and the right middle rod 103.

The central rod 101, the left middle rod 102, the right middle rod 103, left-side rod 104 and right-side rod 105 are elongated polymeric cylinders. The use of polymeric materials for the cylinders significantly reduces the weight of these components leading to a more comfortable wearing experience for the user.

The crossbar 109 transects The Hover Cover 100 and is integrally formed with the brim-support 110. The crossbar 109 is an elongated polymeric cylinder which decreases the weight of this component. Connected to the crossbar 109 is a central support 108. Integrally formed with the crossbar

109 is the central support 108. Also, connected to the crossbar 109 are the left-side arm 106 and right-side arm 107. The left-side arm 106 and right-side arm 107 are flat, elongated essentially linear components that meet the user's head and support The Hover Cover 100 above the user's head. The end of the left-side arm 106 and right-side arm 107 that contacts the user's head slightly curves toward the center of The Hover Cover 100.

The Hover Cover 100 hat cover 301 is comprised of individual components that fit together to form the cover. See Appendix A. The hat cover 301 is constructed to form a channel around the edge of the hat cover 301 and around the circumference of the hat cover 301. The channel on the right-side of the hat cover 301 allows for insertion of the right-side rod 105. The channel on the left-side of the hat cover 301 allows for insertion of the left-side rod 104. The brim-support 110 is similarly inserted into the channel. In this way, the hat cover 301 is attached to The Hover Cover 100. The hat cover 301 can be easily removed and replaced by a new hat cover 301. This way, the hat cover 301 can be used to convey the expression of the user by employing hat covers with various designs such as school emblems, sport team insignias, patriotic displays. See Appendix A.

The hat cover 301 is placed on top of The Hover Cover 100 and covers The Hover Cover 100. The hat cover can be constructed of fabric that forms insignias or designs of entities (schools, universities, sports teams), art (photographs, paintings), or any other visual image.

To use The Hover Cover 100 the user simply dons the hat cover 301 on The Hover Cover 100. Then the user places the combination on their head. With the hat cover 301 on top of The Hover Cover 100, air can circulate between the user's head and the hat on all sides of the hat cover 301 and The Hover Cover 100. This is particularly advantageous in hot or sunny conditions so the user's head remains cool due to the air circulation. The Hover Cover 100 only touches approximately 25% of the circumference of the user's head. Due to its construction, the weight of The Hover Cover 100 is small, on the order of 4 ounces.

The left-side rod 104 and the right-side rod 105 slide through the sleeves formed in the hat cover 301. The rear "pocket" in the fabric cover fits over the to the back fitting 111 of The Hover Cover 100. The hat cover 301 then stretches, to the front bill, and is held forward, by elastic strips, that are attached to the fabric, which slide over plastic posts, that are part of the bill.

The sizer 113 can be moved along the rods to different positions, to adjust for different sized heads. The sizer 113 can also be removed when the user's hair is worn up, in a bun, or clip.

What is claimed is:

1. A hat frame comprised of a back fitting, a brim-support, one central rod that extends from the back fitting to the brim-support, a left-side rod, a right-side rod, a left middle rod that extends in a curve from the back fitting to the brim-support between the central rod and the left-side rod, a right middle rod that extends in a curve from the back fitting to the brim-support between the central rod and the right-side rod, a left-side arm, a right-side arm, a central support, a crossbar, a brim, a hat cover, a length of the hat frame, a width of the hat frame, and a sizer; wherein the left-side arm and right-side arm are flat, elongated essentially linear components that are adapted to meet the user's head and support the hat frame above the user's head; wherein the central rod, the left middle rod, the right middle rod, left-side rod, and right-side rod are elongated polymeric cylinders the back fitting forms five receiving apertures where the central rod, left middle rod, right middle rod, left-side rod, and right-side rod are connected via a resistance fit.

2. The hat frame in claim 1 wherein the central rod, the left middle rod, and the right middle rod span the length of the hat frame and are connected on a back side of the hat frame to the back fitting and on a front side of the hat frame to the brim-support;

the brim-support forms five apertures where the central rod, left middle rod, right middle rod, left-side rod, and right-side rod are connected to the apertures of the brim-support via a resistance fit.

3. The hat frame in claim 2 wherein the left-side rod and right-side rod extend from the back fitting to the brim-support on their respective sides of the hat frame.

4. The hat frame in claim 3 wherein the brim extends forward from the brim-support.

5. The hat frame in claim 4 wherein the sizer snaps into the central rod, the left middle rod, and the right middle rod.

6. The hat frame in claim 2 wherein the brim extends forward from the brim-support.

7. The hat frame in claim 2 wherein the sizer snaps into the central rod, the left middle rod, and the right middle rod.

* * * * *